US005107870A

United States Patent [19]

Beck et al.

[11] Patent Number: 5,107,870

[45] Date of Patent: * Apr. 28, 1992

[54] METHOD FOR MIXING AND APPLYING COSMETIC TO AN APPLICATOR

[75] Inventors: Marlene Beck, New York, N.Y.; Martin M. Vasas, Fairfield, Conn.

[73] Assignee: Elizabeth Arden Co., division of Conopco, Inc., New York, N.Y.

[ * ] Notice: The portion of the term of this patent subsequent to Nov. 27, 2007 has been disclaimed.

[21] Appl. No.: 578,628

[22] Filed: Sep. 16, 1990

Related U.S. Application Data

[63] Continuation of Ser. No. 260,950, Oct. 21, 1988, Pat. No. 4,972,858.

[51] Int. Cl.[5] ..... A45D 40/26

[52] U.S. Cl. ..... 132/218; 132/320; 401/18; 401/126; 401/129

[58] Field of Search ..... 132/216, 218, 320; 401/17, 18, 35, 36, 122, 126, 129; 15/184, 206, 207

[56] References Cited

U.S. PATENT DOCUMENTS

| | | | |
|---|---|---|---|
| 1,029,077 | 6/1932 | Wetzger | 401/18 |
| 1,905,399 | 4/1933 | Wagner | 15/160 |
| 2,131,539 | 9/1938 | Mureau | 132/317 |
| 2,576,550 | 11/1951 | Waters | 132/308 |
| 3,033,213 | 5/1962 | Joss et al. | 132/218 |
| 3,921,650 | 11/1975 | Montgomery | 132/218 |
| 3,925,843 | 12/1975 | Tsuruzawa et al. | 15/184 |
| 4,390,298 | 6/1983 | Caluccio | 401/122 |
| 4,458,701 | 7/1984 | Holland | 132/218 |
| 4,600,328 | 7/1986 | Clements | 401/18 |
| 4,886,080 | 12/1989 | Cole et al. | 132/320 |
| 4,972,858 | 11/1990 | Beek et al. | 132/218 |

FOREIGN PATENT DOCUMENTS

| | | | |
|---|---|---|---|
| 0236133 | 3/1987 | European Pat. Off. | 132/218 |
| 820792 | 11/1951 | Fed. Rep. of Germany . | |
| 2037409 | 7/1970 | Fed. Rep. of Germany | 401/17 |
| 3240152 | 5/1984 | Fed. Rep. of Germany . | |
| 3610007 | 3/1986 | Fed. Rep. of Germany | 401/129 |
| 1310355 | 11/1962 | France | 132/216 |
| 1315639 | 5/1973 | United Kingdom | 401/17 |
| 2064314 | 6/1981 | United Kingdom . | |

*Primary Examiner*—Gene Mancene
*Assistant Examiner*—Frank A. LaViola
*Attorney, Agent, or Firm*—Kenyon & Kenyon

[57] ABSTRACT

The invention provides a novel method for evenly applying cosmetics, especially mascara, to an applicator brush and to the eyelashes. A cosmetic applicator formed with an applicator brush is removed from a container holding the cosmetic in a manner such that the applicator brush rubs against an applicator brush belonging to another applicator, thereby cleaning the brush to remove loose particles of the cosmetic and also causing cosmetic in the vicinity of the rubbing brushes to mix. This mixing action tends to thin ends of the cylindrical container and wherein the eyelash brushes of each of the cosmetic applicators are positioned along substantially the same longitudinal axis when the cap means of both cosmetic applicators are capped onto the container.

18 Claims, 1 Drawing Sheet

10
12
14
16
18
20
22
24
26
28
30
32
34
36
38

METHOD FOR MIXING AND APPLYING COSMETIC TO AN APPLICATOR

BACKGROUND OF THE INVENTION

This invention relates to the application of cosmetics, and more particularly to a device for applying cosmetics, such as mascara, to the eyelashes. The invention further relates to a device which acts as a container for storing cosmetics, especially mascara, when the device is not being used as an applicator. The invention further relates to a device which thins mascara just prior to the application of the mascara to the eyelashes.

The prior art discloses cosmetic applicators and containers for mascara. The typical mascara applicator is a slender rod which is equipped with a brush or a set of bristles at the end for contact with the eyelashes. The brush is inserted into a cylindrical container of the mascara, removed from the container and then contacted with the eyelashes for application.

One of the problems encountered when applying mascara in this manner is difficulty in applying the mascara to the brush and the eyelashes evenly. This difficulty is due to the tendency of the mascara to thicken in the container over periods of time. Excessively thick mascara tends to accumulate on and stick to the applicator brush, making it difficult to apply evenly.

The prior art discloses wipers for removing excess mascara from applicator brushes. For example, U.S. Pat. No. 4,390,298 discloses a wiper plug, defined by a rim or edge of the cosmetic container, for removing excess liquid from the applicator brush when the applicator is removed from the cosmetic container. U.S. Pat. No. 3,033,213 discloses a resilient wiping member for wiping excess mascara off of a mascara brush. U.S. Pat. No. 2,131,539 discloses a serrated edge for evenly distributing mascara on an applicator brush. These prior art devices have been somewhat effective in removing excess mascara from an applicator brush prior to application. However, these devices fail to solve the problem of uneven mascara distribution on the mascara brush caused by mascara which has become thickened over periods of non-use.

Mascara users have attempted to solve the problem of thickened mascara by rapidly moving the applicator brush back and forth within the container in an effort to mix the mascara and, hopefully, thin it. However, this procedure is not completely effective in applying mascara to the brush uniformly and is often an unavoidably sloppy process.

SUMMARY OF THE INVENTION

The invention provides a dual cosmetic applicator and container for applying cosmetics, especially mascara, to the eyelashes. A cosmetic container is provided with two open ends, each end capable of receiving a cosmetic applicator. Each cosmetic applicator is a rod which is provided with a brush or a set of bristles at the end thereof which is designed to be inserted into an open end of the cosmetic container. One applicator may be designed for applying cosmetic to the lower lashes, and the other may be designed for the upper lashes. The opposite end of each cosmetic applicator is equipped with a handle or cap which is designed to close the open end of the container, preferably in a screw-on cap type fashion, when the cosmetic applicator is completely inserted into the container. The distance between the open ends of the container and the length of the rods of the cosmetic applicators are such that when each cosmetic applicator is completely inserted into the container the bristles of each applicator engage each other inside of the container.

When it is desired to apply the cosmetic, such as mascara, inside of the container to the eyelashes, one applicator is removed from the container, preferably by rotating its handle. As the applicator is removed, the mascara located between the brushes is mixed by the action of the bristles rubbing against each other. Since mascara is thixotropic, this mixing action thins or liquefies the mascara applied to the brush so that mascara is applied to the brush, and subsequently the eyelashes, evenly. In addition, the rubbing of the bristles of the two brushes against one another acts to clean the bristles and remove, for example, dried particles of mascara. Preferably, the container is equipped with wiper means at each of its ends for removing excess mascara from the brushes as the applicators are removed from the container.

Accordingly, it is an object of the invention to provide a mascara applicator and container which is capable of mixing and thinning the mascara to be applied to the eyelashes just prior to application.

It is a further object of the invention to provide a cosmetic applicator and container in which the brushes of each applicator engage each other inside of the container.

It is a further object of the invention to provide a cosmetic container containing two cosmetic applicators, each of which is capable of applying cosmetic to the eyelashes.

Additional objects and advantages of the invention may be appreciated upon reading the following specification wherein the preferred embodiment of the invention is described in detail.

BRIEF DESCRIPTION OF THE DRAWINGS

Referring to the accompanying drawings, which are for illustrative purposes.

DESCRIPTION OF THE PREFERRED EMBODIMENT

Figures 1, 2, 3, 4:
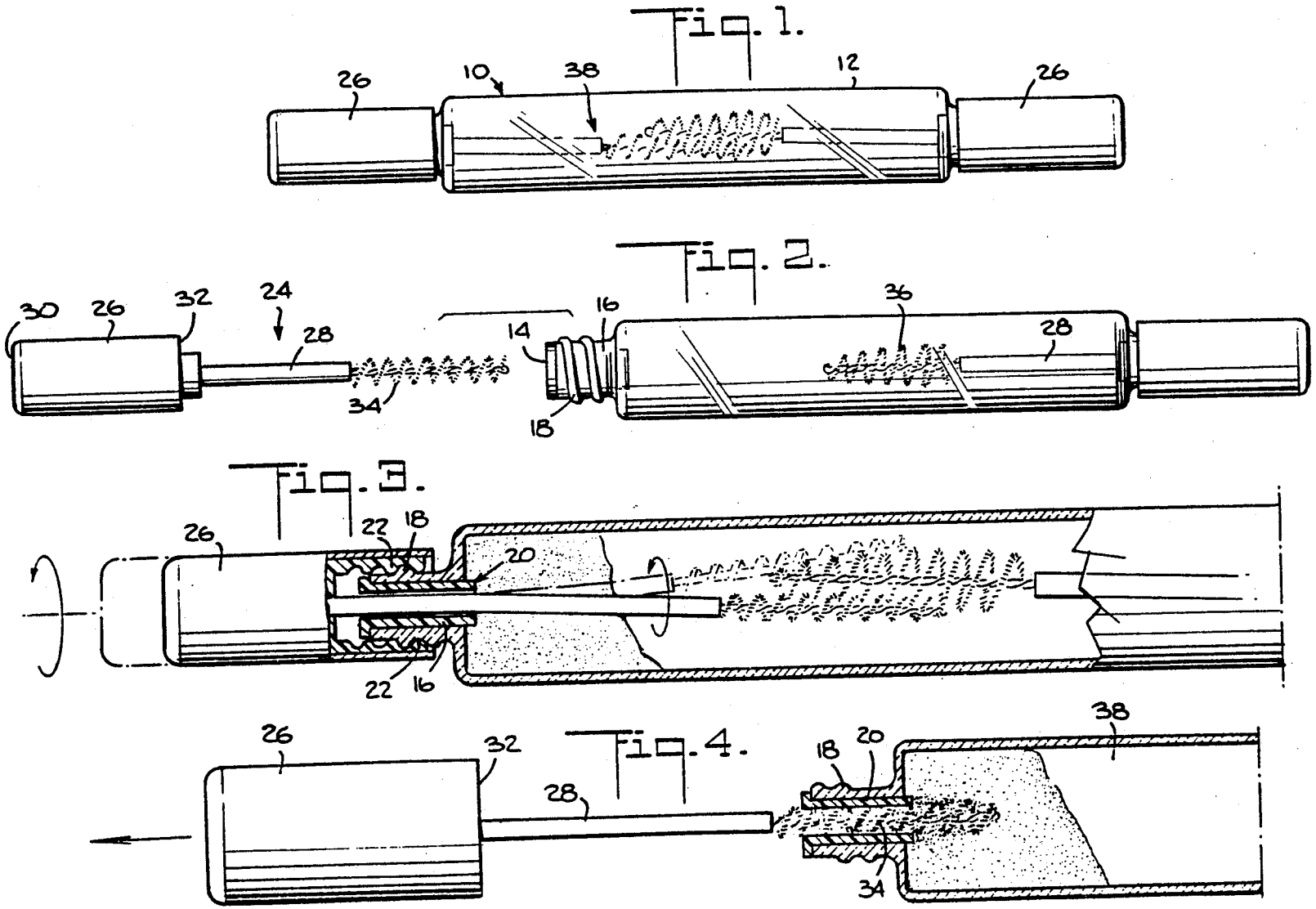
FIG. 1 is a planar view of the dual cosmetic applicator and container of the invention where each cosmetic applicator is completely inserted into the container so as to close it, depicting the engagement of the applicator brushes inside the container.
FIG. 2 is a planar view of the dual cosmetic applicator and container depicting an applicator which has been removed from the container.
FIG. 3 is a detailed view of the container as shown in FIG. 1.
FIG. 4 is another detailed view of the container showing the action of a wiping member on an applicator brush.

Referring to FIG. 1, the dual cosmetic applicator and container of the invention is generally depicted at 10. A hollow container 12 for storing a quantity of cosmetic 38, such as mascara, is provided. The container is preferably cylindrical in shape as depicted. The container may be constructed of a sturdy transparent material such as plastic so that the quantity of cosmetic remaining in the container can be seen.

Each end of the container is provided with an opening 14 for receiving a cosmetic applicator 24 (generally depicted in FIG. 2). As depicted. each cosmetic applicator extends axially into the container 12 through openings 14. The segment of the container 12, near the vicinity of each of the openings 14, is defined by a neck 16 which is provided with external threads 18 on the external surface thereof, whose function shall be explained hereinafter.

Referring to FIGS. 3 and 4, it can be seen that the interior surface of container 12 is provided with a wiper member 20 in each neck 16. Each wiper member 20 is sealed to the inner surface of neck 16 and extends axially from opening 14 into container 12. Each wiper member 20 defines a bore which is of a reduced diameter as compared to the diameter of the container 12 so as to define a wiping surface for the cosmetic applicators as explained hereinafter.

Referring to FIG. 2, a cosmetic applicator is generally depicted at 24. The invention provides at least a pair of cosmetic applicators. Each applicator is defined by a handle or cap 26 which is connected to a slender rod or wand 28. Each handle 26 is a hollow tube having a closed end 30 and an open end 32 which receives rod 28. Rod 28 extends axially into handle 26 through its open end 32 and is attached to the closed end 30 of handle 26. The open end 32 is also designed to receive a neck 16 of the container 12. Referring to FIG. 3, the inner surface of handle 26 is provided with internal threads 22 which are designed to engage with the external threads 18 of neck 16 so that handle 26 may be rotatably fastened to container 12 in a screw on type fashion. It can be seen that before handle 26 is screwed onto neck 16, rod 28 must be inserted into container 12 through opening 14.

An eyelash brush 34 or 36 is fixedly wrapped around a segment of each rod 28 near the free end of each cosmetic applicator 24. Each brush 34 or 36 is comprised of a plurality of bristles which stand on end to extend away from the surface of rod 28 and which are designed to apply mascara to the eyelashes. As appreciated by those skilled in the art, eyelash brush bristles should be both resilient and flexible. Referring to FIG. 4, the circumference of each brush 34, 36 should be slightly larger than that of the bore defined by wiping member 20 so that the brush bristles make contact with and are bent by wiping member 20 when passed therethrough. In this manner, excess mascara is removed from the brush when the cosmetic applicator is removed from the container.

Preferably, the brushes 34 and 36 are of two different designs so that the user has an option of which brush to use. For example, one of the brushes may be designed for use with the lower eyelashes and the other brush for the upper eyelashes. Preferably one brush 34 is comprised of a series of bristles which are all approximately the same size and which are grouped so as to define a series of circumferentially extending grooves on a segment of rod 28 at its free end. The groups of bristles may be arranged so as to define a series of closely spaced annular grooves, or, as depicted in FIG. 2, the bristles may be arranged so as to form a helical thread (defining a helical groove) on rod 28. The second brush 36 is preferably constructed the same way except that the groups of bristles may be spaced closer together than the groups of bristles on the other brush so that only very thin grooves or no grooves are defined. Furthermore, the length of the bristles of the second brush should vary so that the circumference of the brush increases from the free end of rod 28 in the direction towards handle 26 until the approximate axial midway point of the brush (see FIG. 2, brush 36). The length of the bristles from the axial midway point to the end of the brush which is closest to handle 26 should each be approximately the same size and longer than the bristles of the other brush 34 as shown in FIG. 2.

Referring to FIGS. 1 and 3, the dual cosmetic applicator and container is depicted with both cosmetic applicators 24 fastened on the container so as to close its opened ends 14. As can be seen, the length of the rods 28 of each applicator 24 are such that the brushes of each applicator 34, 36 engage each other inside the container 12 when the handles 26 of each applicator are fastened onto the necks 16 of container 12. The brushes of each applicator should interface along a substantial portion of their longitudinal axial length, and preferably along their entire length as depicted in FIGS. 1 and 3.

To apply mascara to the eyelashes, the handle 26 of one of the applicators is unfastened from container 12. As the handle 26 is turned, its brush 34 or 36 rotates around the brush of the other applicator. This rotation causes the bristles to rub against each other and the mascara between the brushes is mixed by this action. Mascara is thixotropic and this mixing action caused by the rotation and turbulence of the brushes has been found to liquefy or thin the mascara which adheres to the brushes so that the mascara can be applied to the eyelashes evenly. In addition, rotation of the brushes against one another acts to clean the brushes and remove, for example, dried particles of mascara. Excess mascara on brush 34 or 36 is wiped off when the applicator is removed from container 12 as the brush passes through the bore of wiping member 20 (see FIG. 4). The brush of the applicator is then stroked along the eyelashes to apply the mascara. Because the mascara which has been picked up by the brush has been thinned, it is easy to apply evenly to the lashes. When more mascara is needed, the brush is reinserted into the container and handle 26 is fastened back onto the neck of the container. The application process is then repeated. It should be noted that in the case of mascara which has been thickened during extended periods of non-use it may be desirable to rotate the brushes in order to thin it to a greater extent.

What is claimed is:

1. A method for applying cosmetic to an eyelash brush removably inserted into a cosmetic container holding a quantity of cosmetic therein, comprising the step of removing the eyelash brush from the container in a manner such that the eyelash brush being removed rubs against another eyelash brush in the container so as to mix cosmetic in the vicinity of the eyelash brushes.

2. The method according to claim 1 wherein the cosmetic is thixotropic.

3. The method according to claim 2 wherein the thixotropic cosmetic is mascara.

4. The method according to claim 3 wherein the step of removing an eyelash brush is conducted in a manner such that mascara in the vicinity of the eyelash brushes is thinned.

5. The method according to claim 4 wherein the eyelash brushes are comprises of a plurality of bristles and wherein the step of removing an eyelash brush is conducted in a manner such that the bristles of said eyelash brushes engage to thin mascara between the bristles.

6. The method according to claim 5 wherein the step of removing an eyelash brush is conducted by rotating that eyelash brush into contact with another eyelash brush.

7. The method according to claim 2 wherein the step of removing an eyelash brush is conducted in a manner such that cosmetic in the vicinity of the eyelash brushes is thinned.

8. The method according to claim 1 wherein the step of removing is conducted in a manner such that dried particles of cosmetic are cleaned from the eyelash brush being removed.

9. A method for applying cosmetic to an eyelash brush of a cosmetic applicator and container, said cosmetic applicator and container comprising a container holding a quantity of cosmetic therein, having at least two openings, each opening for allowing access of an eyelash brush inside of the container, and at least two cosmetic applicators, each cosmetic applicator comprising an eyelash brush and a means coupled to the brush for capping one of the respective openings, said eyelash brushes being removably inserted in the respective openings of said container and capped thereon, said method comprising the step of removing a cosmetic applicator from the container in a manner such that the eyelash brush belonging to the cosmetic applicator being removed rubs against an eyelash brush belonging to another mascara applicator causing cosmetic in the vicinity of the eyelash brushes to mix.

10. The method according to claim 9 wherein the cosmetic is mascara.

11. The method according to claim 10 wherein the step of removing is conducted in a manner such that mascara in the vicinity of the eyelash brushes is thinned upon rubbing of the eyelash brushes.

12. The method according to claim 9 wherein the eyelash brushes engage each other inside the container when said capping means are capped to the container.

13. A method for applying mascara to an eyelash brush of a mascara applicator and container, said mascara applicator and container comprising a container holding a quantity of mascara therein, having at least two necks, each of said necks defining a bore for allowing access of an applicator wand inside of the container, each of said necks having a plurality of threads around the periphery thereof for allowing rotational coupling of each said necks with a cap means, and at least two mascara applicators, each mascara applicator including an applicator wand, an eyelash brush, fixedly wrapped around the periphery of said wand at a free end segment thereof, and a cap means having a bore therein which terminates at a closed end of said cap means, said wand being attached to the closed end of the cap means at a non-free end of the wand, said cap means having a plurality of threads on the surface of its bore which are releasably engaged with the threads on a neck of the container, said applicator wands being removably inserted in the respective bores of said container and capped thereon, said method comprising the step of removing a mascara applicator from the container in a manner such that the eyelash brush belonging to the mascara applicator being removed rubs against an eyelash brush belonging to another mascara applicator causing mascara in the vicinity of the eyelash brushes to mix.

14. The method according to claim 13 wherein the eyelash brush engage each other inside the container when said cap means are capped to the container.

15. A method for applying cosmetic to an eyelash brush of a cosmetic applicator and container, said cosmetic applicator and container comprising a cylindrical container holding a quantity of cosmetic therein having an opening at each of two opposite ends of the container for allowing access of an eyelash brush inside of the container, and a pair of cosmetic applicators, each applicator including an eyelash brush coupled to a means for capping an opening of the container, said eyelash brushes being removably inserted into respective openings of said container and capped thereon, said eyelash brushes of both cosmetic applicators being positioned along substantially the same longitudinal axis, said method comprising the step of removing a cosmetic applicator from the container in a manner such that the eyelash brush belonging to the cosmetic applicator being removed rubs against an eyelash brush belonging to another cosmetic applicator causing cosmetic in the vicinity of the eyelash brushes to mix.

16. The method according to claim 15 wherein the cosmetic is mascara.

17. The method according to claim 16 wherein the eyelash brushes are comprised of a plurality of bristles and wherein the step of removing is conducted in a manner such that the bristles of the eyelash brushes engage so as t thin mascara between the bristles.

18. The method according to claim 15 wherein the eyelash brushes engage each other inside the container when said capping means are capped to the container.

* * * * *